United States Patent [19]

Laing et al.

[11] Patent Number: 4,682,581

[45] Date of Patent: Jul. 28, 1987

[54] SECONDARY CIRCULATION SYSTEM

[76] Inventors: Karsten Laing, 3970 Honeycutt St., San Diego, Calif. 92109; Doerte Laing; Birger Laing, both of Hofener Weg 35, 7148 Remseck 2-Aldingen, Fed. Rep. of Germany

[21] Appl. No.: 828,985

[22] Filed: Feb. 13, 1986

[51] Int. Cl.[4] ..... F24H 1/00

[52] U.S. Cl. ..... 126/362; 237/19

[58] Field of Search ..... 237/19; 126/362, 361; 122/17, 16

[56] References Cited

U.S. PATENT DOCUMENTS 3,941,118 3/1976 Schutte ..... 126/362

4,178,907 12/1979 Sweat, Jr. ..... 237/19 X

*Primary Examiner*—Henry A. Bennet

[57] ABSTRACT

A domestic hot water system in which the remote end forms a loop connected to the hot water tank and in which a pump circulates hot water at a rate sufficient to prevent cooling of the water in the piping below a predetermined temperature, so that hot water can flow immediately out of all outlets.

5 Claims, 5 Drawing Figures

SECONDARY CIRCULATION SYSTEM

BACKGROUND

Known circulating systems have the drawback that a second pipe is necessary, causing doubling of heat losses. Furthermore, it is virtually impossible to install a circulator pipe into existing hot water systems.

SUMMARY OF THE INVENTION

According to the invention, the circulation pipe is located within the hot water pipe. To limit heat exchange between the two water bodies, this pipe must be made from heat insulating materials such a polypropylene, ethylene propylene, perbunan or polybutylene. Also, installation of the circulation pipe can be accomplished by insertion into existing pipes if they do not have too many sharp elbows (e.g., more than two).

This invention is described in the the following figures.

The diameter of all circulation pipes (9) is chosen small enough not to impair the hot water distribution in the pipe (2) of the hot water system, but large enough to permit the necessary flow rate to compensate the heat losses of the pipe (2).

Figure 1:
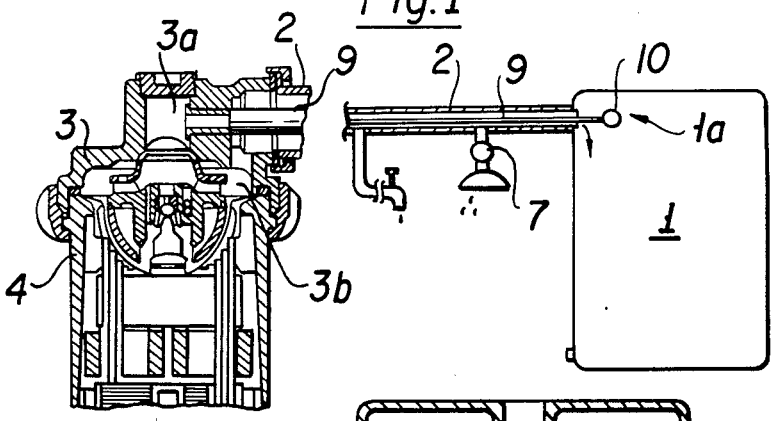
FIG. 1 shows a design with a circulation pump on the remote end of the hot water pipe.

FIG. 1 shows a hot water tank (1) feeding the distribution line (2) with hot water, On the remote end of pipe (2) the circulator pump (3, 4) is installed. Its suction side (3*a*) communicates with the circulation pipe (9) which reaches into the interior of the tank (1). A ball shaped head (10) with inlet openings prevents snagging of the circulation pipe (9) during insertion into pipe (2) with bends. The pressure side (3*b*) of the pump (3, 4) conveys hot water from the hot part (1*a*) of the tank into the pipe (2); therefore, the water entering pipe (2) is always hot. If the shower (7) or tap (8) is opened, hot water flows instantly.

Figure 2:
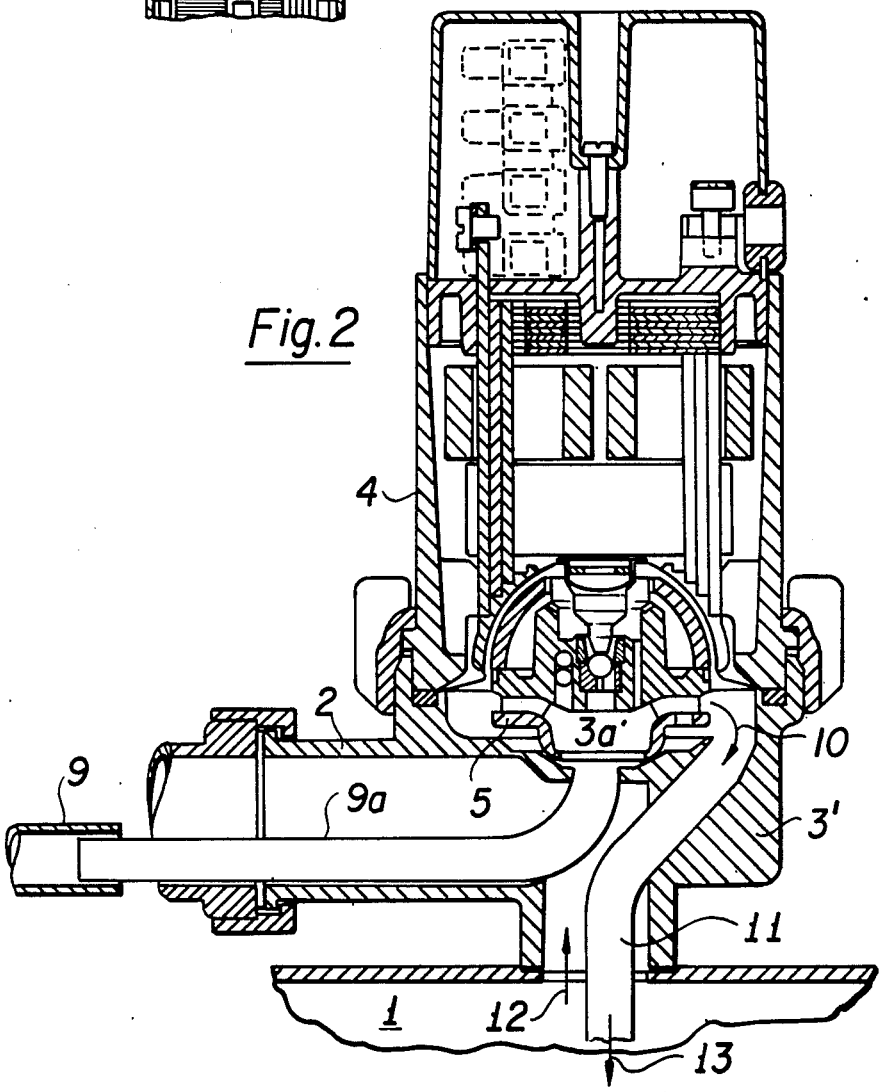
FIG. 2 shows a pump that simultaneously serves as an elbow in the hot water system.

FIG. 2 shows an arrangement whereby the pump housing (3') functions as a bend connecting the inside of the tank (1) with the hot water pipe (2). A circulation pipe (9) reaches till the farthest end of pipe (2) and is connected by pipe (9*a*) with the suction side (3*a*') of the pump (3', 4). The pressure side (10) is connected by pipe (11) with the inside of the tank (1) so that hot water enters the system according to arrow (12) and circulates through the system and returns according to arrow (13).

Figure 3:
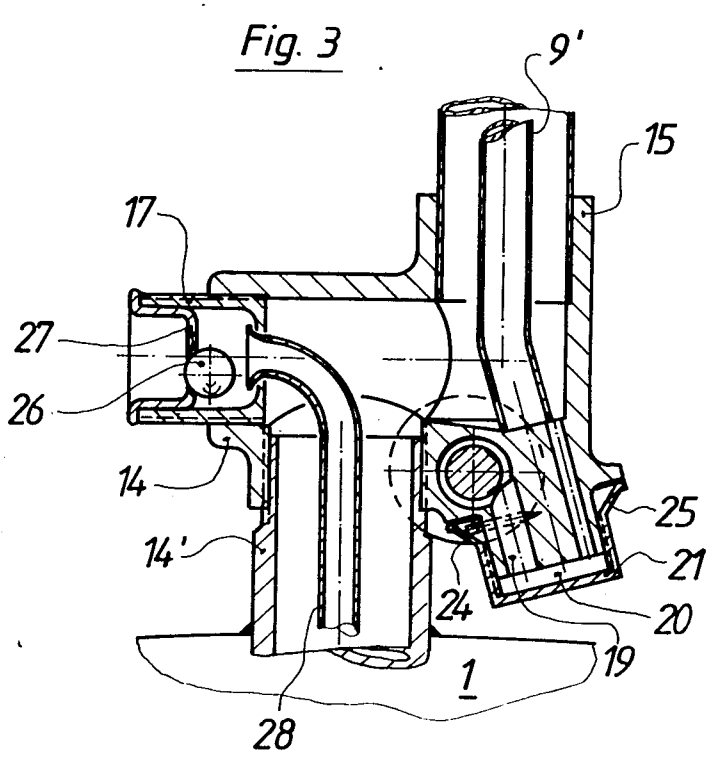
FIG. 3 shows the cross-section of a Y-branch in a vertical plane.

FIG. 3 shows a vertical cross-section through a fitting arranged between the tank (1) and the pump housing.

Figure 4:
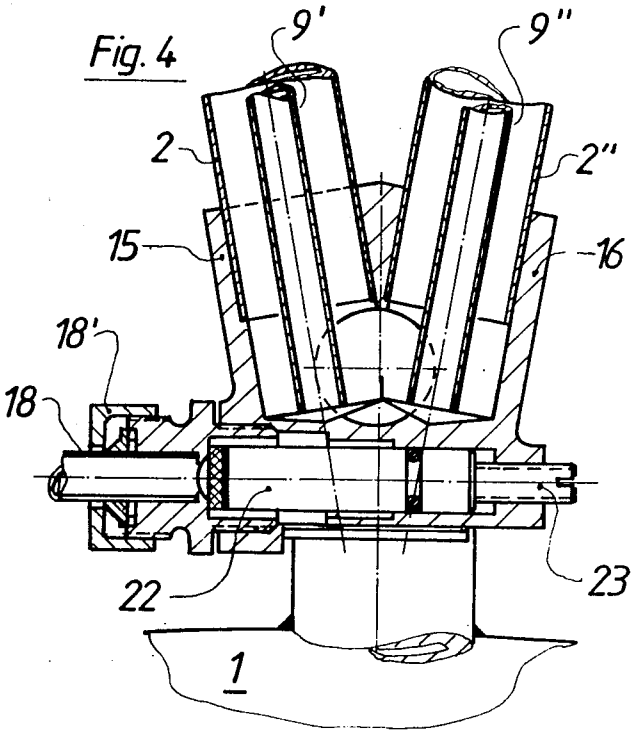
FIG. 4 shows the Y-branch in the vertical plane normal to that of FIG. 3.

FIG. 4 shows a cross-section along the dotted line I—I of FIG. 3.

Figure 5:
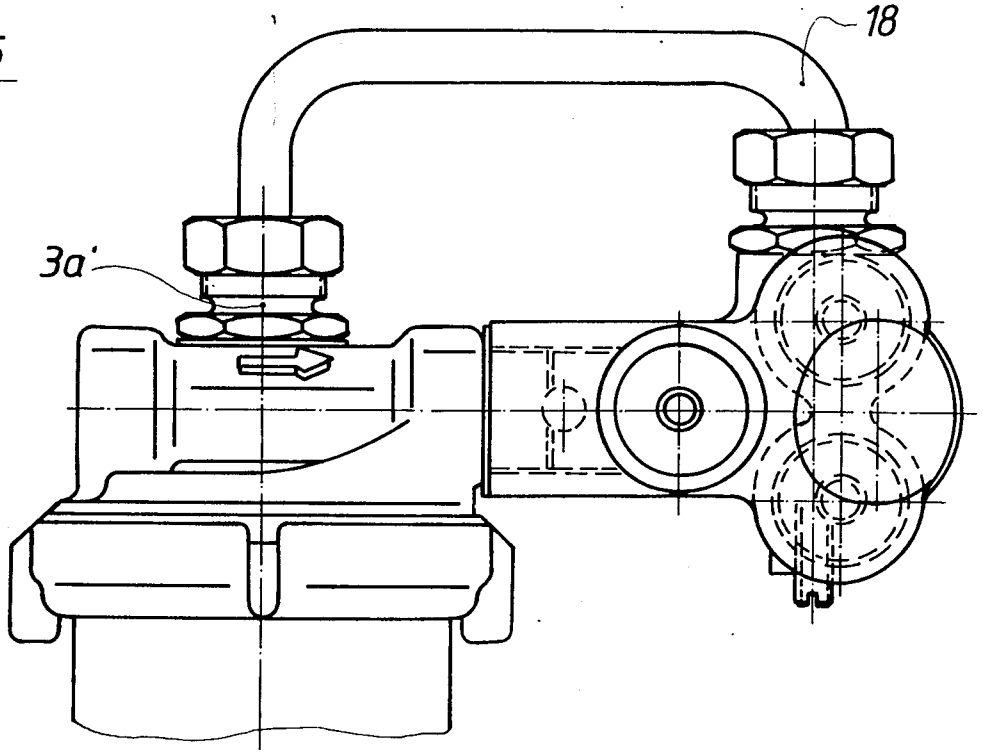
FIG. 5 shows a bottom view of the Y-branch design.

FIG. 5 shows a cross-section along the dotted line II—II of FIG. 3.

In FIGS. 3, 4 and 5, the inlet (14) communicates through the nipple (14') with the hot area of the tank (1), and the two outlet openings (15, 16) are connected with the hot water pipe (2', 2''). Through nipple (17) the fitting is connected with the pressure side (3*b*) of pump (3, 4) as shown in FIG. 1. While the suction side (3*a*) of the pump is connected via pipe (18) through channel (19) with space (20) inside of a cap (21), said space (20) communicates with the two circulation pipes (9', 9''). The piston (22) forms a unit with the thread (23) and allows blockage of the inlet stream through pipe (18). Two needles (24) pressed inward by the tapered region (25) of the cap (21) maintain the relative axial position of the circulation pipes (9', 9''). A ball (26) forms together with an orifice (27) a check valve to prevent the flow of water in a direction opposite to the pumping direction through the pipes (9', 9''), which might otherwise be caused by high velocity in the hot water pipes (2', 2'').

I claim:

1. Circulation system for secondary circulation in a domestic hot water system composed of a distribution pipe, a circulation pipe for secondary circulation, and a pump with a pumphousing having the two openings for inlet and outlet of water, which together form a loop, whereby both ends of the loop communicate with the heat source, e.g. a tank characterized in that the circulation pipe (9), having an inner diameter of about ¼ inch, is situated within the distribution pipe (2), the first end of the circulation pipe (9), communicates with the pump (3,4), the second end of the circulation pipe (9) communicates with the hot region of the heat source (1) (e.g. the upper level of a tank), between the first end of the circulation pipe (9) and one opening of the pumphousing a valve (22, 23) is arranged, the other opening of the pump housing communicates with the interior of the heatsource (1) via a tube (28), between said tube (28) and said other opening of the pump housing a valve (26, 27) is arranged, one of the two valves (22, 23, 26, 27) being a check-valve, preventing backflow through the pump housing caused by pressure difference between the second end of the circulation pipe (9) and the distribution pipe (2).

2. Circulation system for secondary circulation in a domestic hot water system composed of a distribution pipe, a circulation pipe for secondary circulation, and a pump with a pumphousing having the two openings for inlet and outlet of water, which together form a loop, whereby both ends of the loop communicate with the heat source, e.g. a tank characterized in that the circulation pipe (9), having an inner diameter of about ¼ inch, is situated within the distribution pipe (2), the first end of the circulation pipe (9), communicates with the pump (3,4), the second end of the circulation pipe (9) communicates with the the end portion of the distribution pipe (2)

between the first end of the circulation pipe (9) and one opening of the pumphousing a valve (22, 23) is arranged, the other opening of the pump housing communicates with the interior of the heatsource (1) via a tube (28), between said tube (28) and said other opening of the pump housing a valve (26, 27) is arranged, one of the two valves (22, 23, 26, 27) being a check-valve, preventing backflow through the pump housing caused by pressure difference between the second end of the circulation pipe (9) and the distribution pipe (2).

3. Circulation system according to claim 1 or 2, the pump (2,3″,4) having a pump housing (2,3″,9*a*,11), and an impellor (5) communicating with a suction region (9*a*) and a pressure conduit (11) for the secondary circulation of water and having, in addition, a channel connecting the distribution pipe with the tank (1).

4. Circulation system according to claim 1 or 2, characterized in that the pressure side (10) of the pump communicates with the end portion of the circulation pipe (9), and the suction side (3*a*′) communicates with the hot region (1*a*) of the tank (1).

5. Circulation system according to claim 1, characterized in that the end portion of the circulation pipe (9′) is axially positioned in a bore and fixed by a needle (24) piercing the wall of said circulation pipe (9′).

* * * * *